United States Patent [19]

Retford

[11] 3,992,014

[45] Nov. 16, 1976

[54] MOLDED SOLID GOLF BALL COMPRISING A SILANE FOR GREATER VELOCITY

[75] Inventor: David Thomas Retford, Cincinnati, Ohio

[73] Assignee: Brunswick Corporation, Skokie, Ill.

[22] Filed: Oct. 22, 1969

[21] Appl. No.: 868,349

[52] U.S. Cl. ..... 273/218; 260/33.6 A; 260/42.37; 260/824 EP; 260/827; 260/836; 260/837 R; 260/876 R; 260/878 R; 260/879; 260/889; 260/890; 260/998.14

[51] Int. Cl.[2] ..... A63B 37/08; C08L 9/00; C08L 43/04; C08L 63/00

[58] Field of Search ..... 260/41.5, 837, 890, 260/824 EP, 876 R, 878 R, 42.37, 889, 33.6 A, 836, 827, 879; 273/218

[56] References Cited

UNITED STATES PATENTS

| | | | |
|---|---|---|---|
| 3,079,361 | 2/1963 | Plueddemann | 260/41 A |
| 3,290,165 | 12/1966 | Iannicelli | 106/308 |
| 3,313,545 | 4/1967 | Bartsch | 260/41.5 A |
| 3,373,123 | 3/1968 | Brice | 273/218 |
| 3,421,766 | 1/1969 | Chmiel et al. | 260/41 |
| 3,438,933 | 4/1969 | Bartsch | 260/41.5 A |
| 3,478,132 | 11/1969 | Randolph | 260/41.5 |
| 3,502,338 | 3/1970 | Cox | 273/218 |
| 3,553,159 | 1/1971 | Miller et al. | 260/41.5 R |

FOREIGN PATENTS OR APPLICATIONS

| | | | |
|---|---|---|---|
| 764,843 | 8/1967 | Canada | 273/218 |

*Primary Examiner*—Allan Lieberman
*Attorney, Agent, or Firm*—Hofgren, Wegner, Allen, Stellman & McCord

[57] ABSTRACT

A silane is included in a homogeneous golf ball composition which is based on a cross-linked rubber polymer. The silane increases velocity of the golf ball when struck by a club. Such silanes have the formula R—Si(OR′)(OR″) (OR‴) wherein each R is organic. Usually R′, R″ and R‴ will be hydrocarbon and R will usually contain a functional group such as mercapto, amino, acrylic, epoxy and/or ether group.

3 Claims, 1 Drawing Figure

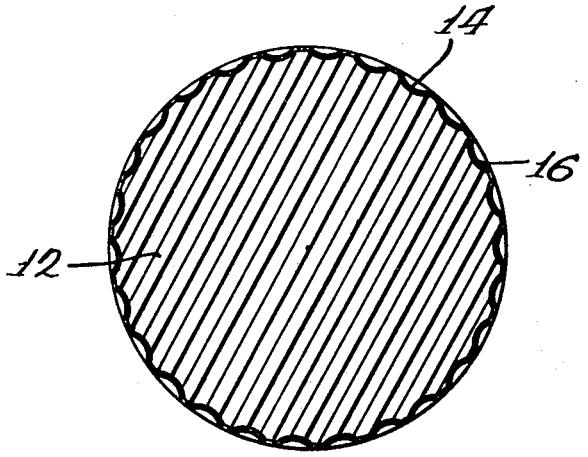
Inventor:
David Thomas Retford
By Hofgren, Wegner,
Allen, Stellman & McCord Att'ys

MOLDED SOLID GOLF BALL COMPRISING A SILANE FOR GREATER VELOCITY

BACKGROUND OF THE INVENTION

1. Field of the Invention

This invention relates to homogeneous golf balls and more particularly relates to improving velocity of such golf balls.

2. Description of the Prior Art

In recent years various formulations of cross-linked rubber or elastomer compositions have been proposed for use in the manufacture of golf balls. The cross-linking of the rubber is accomplished by vulcanization or by a cross-linking compound, such as a divinyl monomer, to provide a stronger and more impact resistance structure which is adapted for use in one piece homogeneous golf balls. Formulations for homogeneous golf balls are described, for example, in U.S. Pat. Nos. 3,239,228, 3,241,834, 3,313,545, 3,452,986, copending application Ser. No. 640,308, filed May 22, 1967, and Canadian Pat. No. 650,959. However, many homogeneous golf balls made by such compositions do not have highly desired velocity characteristics of a rubber wound core ball when struck by a golf club.

SUMMARY OF THE INVENTION

In accordance with the present invention, the velocity of a homogeneous golf ball is improved by including a silane in the formulation from which the golf ball is molded. Usually the golf ball formulation will include a natural or synthetic polymer which is cross-linked during molding of the golf ball by vulcanization or by a cross-linking monomer. The silane is included in the formulation in a minor amount sufficient to enhance the velocity characteristics of the ball when struck by a club.

While this invention is susceptible of embodiment in many different forms, there is shown in the drawings and will be described herein in detail a form of the invention with the understanding that the present disclosure is to be considered as an exemplification of the principles of the invention and is not intended to limit the invention to the embodiment illustrated.

DESCRIPTION OF THE DRAWING

The FIGURE of the drawing is a cross section through a homogeneous golf ball prepared in accordance with this invention.

DESCRIPTION OF THE PREFERRED EMBODIMENTS

The FIGURE shows a golf ball which includes a homogeneous spherical mass 12 having its dimpled exterior surface 14 painted with a suitable coating 16. The basic formulation for the homogeneous vertical portion 12 can be any of those described in the above U.S. patent and application and Canadian patent and the descriptions of such patents and application are hereby incorporated herein by reference in support of such formulations. In accordance with the present invention, a small amount of silane, e.g., from about 0.1 to about 20 and preferably from about 1 to about 10 parts by weight per 100 parts by weight of rubber polymer in the formulation, is included in the mixture prior to molding the golf ball. Any organic silane can be used with some success but usually the silane will have the formula $R—Si(OR')(OR'')(OR''')$ wherein each R is organic. For example, each of R′, R″ and R‴ can be the same or different hydrocarbon radicals and R can be selected from radicals including a mercapto amino, acrylic, epoxy and/or ether moiety. The preferred silanes are those in which R′, R″ and R‴ are each methyl and R is selected from the group consisting of $HS(CH_2)_x$ (i.e., mercapto alkyl), $NH_2(CH_2)_x$ (i.e., aminoalkyl), $CH_2{=}C(R_1)COO(CH_2)_x$ wherein $R_1$ is $C_1$ to $C_6$ lower alkyl (i.e., acrylic) and

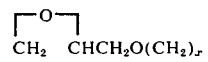

(i.e., epoxy ether alkyl), wherein each $x$ is the same or a different integer of from 1 to about 6.

For example, a homogeneous golf ball can be made by molding a composition which contains a rubber component having a polymer of butadiene as the predominate rubber polymer and also containing the silane compound. The polybutadiene component is preferably present in a major amount when compared with any other single ingredient of the composition and usually contains at least about 60% cis-polybutadiene. The composition can also advantageously contain a reinforcing modifier such as polyvinyl chloride or preferably a thermoplastic polycondensation product of Bisphenol A and epichlorhydrin, each of which is compatible with the rubber component. The polybutadiene can be cross-linked during molding by vulcanization using the usual vulcanizing agents or by including a cross-linking monomer in the formulation such as a polymerizeable divinyl compound for cross-linking the rubber component. Other polymeric ingredients may be present, e.g., a low molecular weight polymeric plasticizer, such as polyethylene. The polyethylene plasticizer is used in the preferred balls in a small amount, but even the small amount is effective as a plasticizer; other plasticizers can also be used as desired, or the plasticizer can be omitted entirely. An example of a suitable polymeric plasticizer is Epolene N-11 which is a low molecular weight polyethylene designed for compounding rubber formulations.

The preferred relative amounts of aforementioned ingredients are as follows:

| Ingredient | Parts by Weight |
|---|---|
| Rubber component including cis-polybutadiene | 100 |
| Reinforcing modifier | 10–90 |
| Polymeric plasticizer | 0–10 |
| Cross-linking monomer | 5–50 |

Where the cross-linking monomer is used to cross-link at least the rubber component of the composition, it is preferred that a polymerization catalyst be present in the composition, although the cross-linking agent can be polymerized by subjecting the formulation to sufficient heat or other polymerization conditions. The polymerization catalyst is used in a catalytically effective amount and usually in an amount ranging from 0.1% based on the cross-linking monomer to 5% based on the total monomer plus rubber component plus other cross-linkable components such as the polymeric plasticizer. The preferred range of catalyst is from 0.5 to 10 parts by weight per 100 parts by weight rubber component. The polymerization catalyst is capable of initiating polymerization of ethylenically unsaturated groups and can be, for example, a free radical type polymerization catalyst. The preferred catalysts are the peroxides, including hydroperoxides and peracids, such as dicumyl peroxide, benzoyl peroxide, cumene hydroperoxide, t-butyl hydroperoxide, methylethylketone peroxide, peracetic acid, t-butyl perphthalate, and the like.

In addition to the aforementioned ingredients, solid particulate filler materials, e.g., 1–50% based on weight of rubber polymer, can be included in the formulation as needed or desired to impart specific properties to the molded article. For example, for golf ball applications, such filler materials as zinc oxide, magnesium oxide, silica, hydrated silica such as HiSil 233, carbon black, lithium oxide, and the like, can advantageously be used to improve the scratch and abrasion resistance of the composition. These filler materials are conventional.

Examples of suitable predominate cis-polybutadiene rubber components are polybutadiene polymerized with a sterospecific catalyst to provide at least 60% cis-polybutadiene with the remainder trans-polybutadiene and/or 1,2-polybutadiene; copolymers, including block copolymers and inter-polymers, of cis-polybutadiene with other polymeric materials such as polystyrene, polyisoprene, polyethylene, polyvinylidene chloride, polyvinyl chloride, polytetrafluoroethylene, and the like; blends of cis-polybutadiene with natural rubber and other synthetic rubbers such as nitrile rubber, GRS rubber, Buna-N, etc., and the like.

The reinforcing modifier is either polyvinyl chloride or a thermoplastic polycondensation product of Bisphenol A and epichlorhydrin. Specific examples are Geon 101 which is a polyvinyl chloride homopolymer marketed by B. F. Goodrich Chemical Company and Bakelite Phenoxy Resin PAHJ or PKHH which are thermoplastic phenoxy resins having a basic chemical structure similar to that of epoxy resins but differing from epoxy resins by their high molecular weight of about 30,000 and by the absence of terminal high reactivity epoxy groups. Other useful reinforcing modifiers will be evident to those in the art.

The reinforcing modifier apparently functions to improve the impact resistance, low fatigue life and poor compression of the cis-polybutadiene and also imparts good ball click sound to a golf ball molded from the formulation. At the same time the modifier does not adversely materially detract from the good rebound properties of the cis-polybutadiene.

The cross-linking monomer can be any of the monomers having at least two ethylenically unsaturated polymerizable groups including the hydrocarbon monomers such as isoprene, butadiene, divinyl benzene, and the like; the polyallyl esters of polycarboxylic acid such as diallyl phthalate, triallyl citrate, diallyl fumarate, triallyl trimellitate, etc.; the polyallyl ethers such as diallyl diethylene glycol, diallyl trimethylol propane, and the like; the unsaturated low molecular weight esters of polycarboxylic acids and mono- or polyhydric alcohols, monocarboxylic acids, and the esters of unsaturated monocarboxylic acids and polyhydric alcohols such as allyl fumarate, diallyl fumarate, low molecular weight esters of maleic acids and ethylene glycol or the like, glycol fumarate, etc. Particularly preferred cross-linking monomers are the polyacrylic esters of polyols, which are formed by esterifying at least two molecules of an acrylic acid, such as methacrylic, ethacrylic, chloracrylic, acrylic, or cyanoacrylic acid, with a suitable polyol; these include butylene glycol dimethacrylate, ethylene glycol dimethacrylate, ethylene glycol dichloroacrylate, triethylene glycol diethacrylate, tetraethylene glycol dimethacrylate, trimethylol propane trimethacrylate, glycerol trimethacrylate, cyclohexanediol dimethacrylate, tetramethylol cyclohexane triacrylate, ethylene glycol dicyanoacrylate, and the like.

In order to exemplify the compositions of the present invention, five Examples and three comparative Preparations are offered. The Examples are by way of illustration and are not intended as limitations on the inventive concept.

EXAMPLES 1–5

Examples 1–5 and Preparations 1–3 were prepared using the ingredients in Table I in the amounts indicated and using the procedure immediately following Table I.

TABLE I

| | Parts by Weight | | | | | | | |
|---|---|---|---|---|---|---|---|---|
| | Prep. 1 | Ex. 1 | Prep. 2 | Ex. 2 | Prep. 3 | Ex. 3 | Ex. 4 | Ex. 5 |
| Ingredients | | | | | | | | |
| Ameripol 220 (1) | 100 | 100 | 100 | 100 | 100 | 100 | 100 | 100 |
| PAHJ | 43 | 43 | — | — | 43 | — | — | 43 |
| Geon 101 | — | — | 43 | 43 | — | 43 | 43 | — |
| AC 615 (2) | 3 | — | 3 | — | 3 | — | — | 3 |
| Fillers | 28 | 20 | 28 | 20 | 28 | 20 | 20 | 28 |
| TMPTMA (3) | 20 | 25 | 20 | 25 | 20 | 25 | 25 | 20 |
| Mark 462 (4) | — | — | 1.5 | 1.5 | — | 1.5 | 1.5 | — |
| Silane A-189 (5) | — | 5 | — | 5 | — | 5 | 5 | 3 |
| Luperco 101XL (6) | 2.75 | 2.0 | 2.75 | 2.0 | 2.75 | 2.5 | 3.0 | 2.75 |

(1) A polybutadiene having in excess of 95% cis-configuration, remainder trans-, marketed by B. F. Goodrich Company.
(2) Low molecular weight polyethylene as plasticizer, marketed by Allied Chemical Co.
(3) Trimethylolpropane trimethacrylate.
(4) Stabilizer for polyvinylchloride marketed by Argus Chemical Co.
(5) Gamma-mercapto-propyl trimethoxysilane, marketed by Union Carbide and Carbon Co.
(6) 2,5-dimethyl-2,5-bis(t-butylperoxy)hexane (45% on an inert filler) marketed by Wallace & Tiernan, Inc.

Rubber mill rolls were heated to 240° F. and a small portion of the Ameripol was banded on the rolls. The reinforcing modifier was then added and dispersed as granules. The mill roll temperature was increased to obtain a 270°–290° F. stock temperature so that the reinforcing modifier could be mixed in smoothly. The polyethylene, where used, was then added and milled in. The stocks were then removed and cooled to room temperature and were rebanded to a cold mill at less than 100° F. The remaining components were added and mixed.

Each of the stocks prepared as above was formed into a solid rod of about 1½ inches in diameter and cut into lengths such that each piece weighed about 1.8 ounces. The rods were formed by rolling a thin sheet of the stock into a rod shape, although extrusion of the rod shapes would more advantageously be used. A series of balls was prepared from each stock. For each ball, a cut piece from the stock was placed in a golf ball mold and then the mold was closed in a press. The material was cured for 20 minutes at a temperature of 320° F. in the closed mold. The mold was then opened and the cured ball removed.

The balls were finished by a standard procedure, painted with a polyurethane paint, and finally stamping printed indicia on the ball.

A series of balls was prepared from each of the formulations of Examples 1 to 5 and the Preparations 1 to 3 according to the foregoing procedure. The balls were tested for a number of properties and the results are listed in Table II below. Each test conducted is conventional for golf balls.

TABLE II

| | Prep. 1 | Ex. 1 | Prep. 2 | Ex. 2 | Ex. 3 | Ex. 4 | Prep. 3 | Ex. 5 |
|---|---|---|---|---|---|---|---|---|
| Hardness, Shore C | 80 | 78 | 77 | 76 | 79 | 81 | 77 | 78 |
| Rebound, 72" drop, % | 78.5 | 84.0 | 80.3 | 85.5 | 84.0 | 80.5 | 78.5 | 80 |
| Compression, Atti | 69 | 60 | 54 | 45 | 59 | 71 | 69 | — |
| Initial Velocity Ft/Sec. less than Control | 7.5 | 4.0 | 8.7 | 6.4 | 4.5 | 4.8 | 5.8 | 4.2 |

The compression was tested on an Atti Engineering Corporation golf ball compression tester. This tester is a device which measures the resistance of a golf ball to deformation. The tester consists of a lower movable platform and an upper, movable, spring loaded anvil. A dial indicator is mounted such that it measures the upward movement of the spring loaded anvil. A golf ball is placed on the lower platform, which is then raised a fixed distance. The upper portion of the golf ball comes in contact with and exerts a pressure on the spring loaded anvil. Depending on the resistance of the golf ball to be compressed, the upper anvil is forced upward against the spring. The dial indicator, showing the amount of movement of the anvil, reads in arbitrary units from 0 to 100. A maximum compression of 200 can be measured and is indicated by two revolutions of the dial indicator.

The Initial Velocity was tested on a USGA design velocity test machine. The USGA velocity test machine is a device developed and used by the United States Golf Association to test for liveliness of golf balls. This machine consists of a ball driving mechanism and a speed sensing section. A ball is placed in the machine and is mechanically positioned in line with a rotating flywheel. The flywheel is driven at a speed, usually 1800 RPM, adjusted to drive a commercial control wound golf ball at a velocity of 250 feet per second and has a protruding lug which strikes the ball. The ball passes through and breaks a light beam causing a light sensor to start a timer. The ball then passes through a second light beam which causes a second light sensor to stop the timer. The distance between the light beams (10 feet) and the time required to travel this distance are used to calculate an Initial Velocity. The results are reported above as the difference in velocity from the commercial control golf ball. The target is the 250 feet per second velocity of the wound golf ball and the data show marked improvement toward this goal.

Additional balls were made according to Examples 1–4 except that the 320° F. cure cycle was extended to 25 and 30 minutes with the following results:

TABLE III

| | Ex. 1 | Ex. 2 | Ex. 3 | Ex. 4 |
|---|---|---|---|---|
| Cure 25 Min. at 320° F. | | | | |
| Hardness, Shore C | 80 | 79 | 82 | 83 |
| Rebound, 72" drop, % | 80 | 83.5 | 79.3 | 75.8 |
| Compression, Atti | 73 | 60 | 70 | 76 |
| Initial Velocity, Ft/Sec. Less than Control | 2.1 | 2.9 | 3.8 | 4.1 |
| Cure 30 Min. at 320° F. | | | | |
| Hardness, Shore C | 84 | 82 | 83 | 84 |
| Rebound, 72" drop, % | 78.5 | 82 | 78.3 | 73.5 |
| Compression, Atti | 72 | 62 | 71.5 | 79 |
| Initial Velocity, Ft/Sec. less than Control | 1.6 | 2.9 | 3.9 | 5.0 |

EXAMPLE 6

The procedure of Examples 1–5 was repeated using a formulation of 100 pbw Ameripol 220, 43 pbw Geon 101, 15 pbw Mark 462, 5 pbw Silane A-189, 25 Pbw hydrated silica filler, 25 pbw TMPTMA and 2 pbw Luperco 101XL. Balls were made using 320° F. cure cycles of 20, 25 and 30 and had the following properties:

TABLE IV

| Press Cure time at 320° F., Min. | 20 | 25 | 30 |
|---|---|---|---|
| Hardness, Shore C | 77–78 | 79–80 | 83–84 |
| Rebound, 72" drop, % | 84 | 84 | 83 |
| Compression, Atti | 39 | 58 | 67 |
| Velocity difference from control (ft/sec) | | | |
| At 200 control velocity | −4.2 | −2.7 | −3.0 |
| At 250 control velocity | −8.0 | −4.6 | −3.6 |

Results of using Silane A-189 in a homogeneous golf ball formulation showed such improvement in velocity characteristics that a formulation similar to that of Preparation 2 was compounded using each of the silanes of Table V as additives in the amounts indicated. Balls made from the formulation and velocity measurements are reported in Table V in terms of ft./sec. over the measured 5 foot distance in the velocity test. No commercial ball controls were used here and the test flywheel was preset and run at 1800 RPM during all velocity tests reported in Table V.

TABLE V

| Composition | Silane Identity | Silane phr[7] | Velocity, ft/sec |
|---|---|---|---|
| Preparation 4 | — | 0 | 210.5 |
| Example 7 | Y4523[8] | 1 | 211.6 |
| Example 8 | Y4523 | 2 | 212.7 |
| Example 9 | Y4523 | 3 | 214.3 |
| Preparation 5 | — | 0 | 209.8 |
| Example 10 | A1100[9] | 1 | 212.1 |
| Example 11 | A1100 | 2 | 212.4 |
| Example 12 | A1100 | 3 | 210.2 |
| Preparation 6 | — | 0 | 209.8 |
| Example 13 | Z6030[10] | 1 | 210.8 |
| Example 14 | Z6030 | 2 | 211.7 |

TABLE V-continued

| Composition | Silane Identity | Silane phr[7] | Velocity, ft/sec |
|---|---|---|---|
| Example 15 | Z6030 | 3 | 211.5 |

[7]Parts by weight per 100 parts Ameripol 220.
[8]Same as Silane A-189 and having the reported structure: $HSCH_2CH_2CH_2Si(OCH_3)_3$, available from Union Carbide and Carbon Co.
[9]An amino silane have the reported structure: $NH_2CH_2CH_2CH_2Si(OCH_3)_3$, available from Union Carbide and Carbon Co.
[10]An acrylic silane having the reported structure: $CH_2{=}C(CH_3)COOCH_2CH_2CH_2Si(OCH_3)_3$, available from Dow Corning Co.

Balls were also made using an epoxy silane, i.e., Dow Corning Z6040 [reported to have the structure

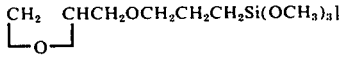

in lieu of the above silanes. Based on test results, the mercapto silanes are particularly preferred because they are apparently more effective and apparently produce a velocity increase as a function of concentration up to a higher concentration level.

All percents and parts given herein are by weight unless otherwise indicated.

The results indicated in Table V are not directly comparable with the results shown in Table II, as the testing equipment used was not identical in both cases.

The formulations of Prep. 4, Prep. 5 and Prep. 6 are the same as the formulation of Prep. 2 using each of the silanes of Table V in the amounts indicated. The results indicate the preparation of a useful golf ball with the compositions exemplified.

I claim:

1. A homogeneous golf ball comprising a crosslinked rubber polymer in which the rubber polymer is at least about 60% cis-polybutadiene and is crosslinked with 5 to 50 phr of a crosslinking monomer having at least two acrylic groups, from about 1 to about 50 parts by weight solid particulate filler based on rubber polymer and from about 1% to about 10% by weight of a silane having the formulation $R{-}Si(OCH_3)_3$ wherein R is selected from the class consisting of $HS(CH_2)_3$, $NH_2(CH_2)_3$, $CH_2{=}C(CH_3)\ COO(CH_2)_3$, and

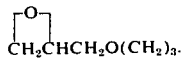

2. A molded solid golf ball comprising a spherical unitary body made by vulcanization of the composition consisting essentially of the following ingredients in the weight ratios stated:

about 100 parts of a high cis content polybutadiene
about 5 to 50 parts of a polyfunctional, ester type, crosslinking monomer
about 0.5 to 10 parts of a peroxide curing agent
about 25 parts of particulate filler material and
about 0.1 to 20 parts of silane wherein said silane has a formula $R{-}Si(OR')(OR'')(OR''')$ wherein R', R'' and R''' are alkyl and R is selected from the class consisting of mercapto alkyl, amino alkyl, acrylic and epoxyether alkyl.

3. A molded solid golf ball comprising a spherical unitary body made by vulcanization of the composition consisting essentially of the following ingredients in the weight ratios stated:

about 100 parts of a high cis content polybutadiene
about 5 to 50 parts of a polyfunctional ester type, crosslinking monomer
about 0.5 to 10 parts of a peroxide curing agent
about 1–50 parts of particulate filler material and
about 0.1 to 20 parts of silane wherein said silane has a formula $R{-}Si(OR')(OR'')(OR''')$ wherein R', R'' and R''' are alkyl and R is selected from the class consisting of mercapto alkyl, amino alkyl, acrylic and epoxyether alkyl.

* * * * *